United States Patent [19]

Nakaniwa

[11] Patent Number: 4,870,938

[45] Date of Patent: Oct. 3, 1989

[54] ELECTRONIC AIR-FUEL RATIO CONTROL APPARATUS IN INTERNAL COMBUSTION ENGINE

[75] Inventor: Shinpei Nakaniwa, Isesaki, Japan

[73] Assignee: Japan Electronic Control Systems Co., Ltd., Gunma, Japan

[21] Appl. No.: 241,195

[22] Filed: Sep. 7, 1988

[30] Foreign Application Priority Data

Sep. 11, 1987 [JP] Japan ..... 62-226606

[51] Int. Cl.[4] ..... F02M 51/00

[52] U.S. Cl. ..... 123/489; 123/440

[58] Field of Search ..... 123/489, 416, 417, 440, 123/480, 486

[56] References Cited

U.S. PATENT DOCUMENTS

| | | | |
|---|---|---|---|
| 4,615,319 | 10/1986 | Tomisawa | 123/440 |
| 4,655,188 | 4/1987 | Tomisawa | 123/489 |
| 4,715,344 | 12/1987 | Tomisawa | 123/489 |
| 4,729,359 | 3/1988 | Tomisawa | 123/440 |
| 4,751,906 | 6/1988 | Yataba et al. | 123/489 |
| 4,751,909 | 6/1988 | Otoba | 123/489 |
| 4,763,629 | 8/1988 | Okazaki et al. | 123/489 |
| 4,766,868 | 8/1988 | Shibata | 123/489 |
| 4,771,752 | 9/1988 | Nishimura et al. | 123/489 |
| 4,771,753 | 9/1988 | Ohishi | 123/489 |
| 4,779,414 | 10/1988 | Nagai et al. | 123/489 |

FOREIGN PATENT DOCUMENTS

| | | | |
|---|---|---|---|
| 267764 | 5/1988 | European Pat. Off. | 123/489 |
| 267765 | 5/1988 | European Pat. Off. | 123/489 |
| 2165063 A | 4/1986 | United Kingdom | 123/440 |

*Primary Examiner*—Raymond A. Nelli

*Attorney, Agent, or Firm*—Sandler & Greenblum

[57] ABSTRACT

An electronic air-fuel ratio control apparatus in an internal combustion engine provided with a learning correction function correcting a basic fuel injection quantity in response to engine states and with an oxygen sensor emitting an output voltage in response to an oxygen concentration including the same in nitrogen oxides in an exhaust gas from the engine controls an air-fuel ratio by a feedback-control of an air-fuel ratio based on a fuel injection quantity in an on-off manner. By using the oxygen sensor having the nitrogen oxides-reducing catalytic layer, the detection of a theoretical air-fuel ratio is performed on a richer side comparing with the output on the detection of a theoretical air-fuel ratio by an oxygen sensor without the nitrogen oxides-reducing function and is not changed even though the nitrogen oxides concentration changes. Accordingly, the feedback air-fuel ratio control effects to decrease the amount of nitrogen oxides so as to omit mounting of EGR control system and to stabilize the air-fuel ratio control. The basic air-fuel ratio is corrected according to a learning correction coefficient which is renewed in respect to the engine states so that the preferable basic air-fuel ratio is attained when the feedback air-fuel ratio controlling is stopped at a high load and high speed engine driving state or at a transient engine driving state.

9 Claims, 10 Drawing Sheets

ELECTRONIC AIR-FUEL RATIO CONTROL APPARATUS IN INTERNAL COMBUSTION ENGINE

BACKGROUND OF THE INVENTION (1) Industrial Application Field

The present invention relates to an electronic air-fuel ratio control apparatus in an internal combustion engine, which is provided with an electronically controlled fuel-injecting apparatus and has a function of performing feedback control of the air-fuel ratio by controlling a fuel injection quantity based on a signal from an oxygen sensor arranged in the exhaust system of the engine.

(2) Related Arts

An electronically controlled fuel-injecting apparatus in an internal combustion engine has a fuel-injecting valve in the intake system of the engine to inject a fuel at a predetermined timing synchronously with the revolution of the engine or a predetermined time period. In this electronically controlled fuel-injecting apparatus, a basic fuel injection quantity is set based on parameters of driving states of the engine (such as the flow rate of air sucked in the engine and the revolution number of the engine etc.) participating in the quantity of air sucked in the engine. A final fuel injection quantity is determined by appropriately correcting the set basic fuel injection quantity.

According to one method for performing this correction, an oxygen sensor is arranged in the exhaust system of the engine, and the correction is performed based on a signal from the oxygen sensor under predetermined engine-driving conditions. More specifically, the air-fuel ratio of an air-fuel mixture sucked in the engine is detected through the oxygen concentration in the exhaust gas by this oxygen sensor, and the output voltage (electromotive force) abruptly changes with the point of combustion of the air-fuel mixture at the theoretical air-fuel ratio being as the boundary and a lean signal of a small output voltage or a rich signal of a large output voltage is emitted. Based on this lean or rich signal, an air-fuel ratio feedback correction coefficient is set by proportion-integration control, and a fuel injection quantity is computed by multiplying the basic fuel injection quantity by the air-fuel ratio feedback correction coefficient, whereby the air-fuel ratio is feedback-controlled to the theoretical air-fuel ratio.

Under driving conditions where the concentration of nitrogen oxides (hereinafter referred to as "$NO_x$") in the exhaust gas, exhaust gas recycle (EGR) control of reducing the $NO_x$ concentration by lowering the combustion temperature by recycling a part of the exhaust gas to sucked air is carried out in parallel to the above-mentioned air-fuel ratio control.

However, in the EGR system for reducing $NO_x$, since an EGR passage or an EGR control valve is necessary, the structure is complicated and the cost is increased. Moreover, the combustion efficiency is drastically reduced by introduction of the exhaust gas into the mixture to be sucked into the engine and the output performance is degraded, and by lowering of the combustion temperature, the emission amounts of unburnt components such as CO and HC are increased.

Under this background, an oxygen sensor comprising an $NO_x$-reducing catalyst layer for promoting the reaction of reducing $NO_x$ was proposed by the present applicant (see U.S. Pat. Application Nos. 117,507 and 117516).

The brief function of the $NO_x$ reducing oxygen sensor will now be described hereinafter. The conventional oxygen sensor emits a high or low voltage with respect to a certain slice level basing on an oxygen concentration in the exhaust gas from the engine and when the output voltage is reversed between the high and low voltage the air-fuel ratio is recognized as the theoretical air-fuel ratio. However, the conventional oxygen sensor can not detect the oxygen concentration in the $NO_x$ component in the exhaust gas which should be taken into consideration as a part of oxygen concentration in the exhaust gas since the oxygen component in the $NO_x$ might be used for the combustion of the fuel and therefore the oxygen component should concern the oxygen concentration in the air-fuel ratio. Therefore the theoretical air-fuel ratio detected by the conventional oxygen sensor has represented only the pretended theoretical air-fuel ratio which is richer than the real theoretical air-fuel ratio by the oxygen concentration including in the $NO_x$. Further the pretended theoretical air-fuel ratio has changed in response to the concentration of the $NO_x$ which has been produced with the concentration changeable due to the various engine driving states. Such an unprecise detection of the theoretical air-fuel ratio has resulted in unprecisely controlling of the air-fuel ratio in the lean side of the true theoretical air-fuel ratio by the electronic air-fuel ratio control apparatus so that increasing of the $NO_x$ concentration was performed (FIG. 9) and that the inferior combustion of the mixture in the combustion chamber of the engine and consequently the inferior engine performance was carried out and also a conversion efficiency of the ternary catalyst mounted on the exhaust system was worsened in an emission condition (FIG. 10).

On the other hand the proposed $NO_x$-reducing oxygen sensor can reduce $NO_x$ to detect the oxygen concentration in $NO_x$ with the result of the output value thereof in response to the real air-fuel ratio which is not influenced by the change of the $NO_x$ concentration.

A method proposed in U.S. patent application Ser. No. '88, 179,535. in which the air-fuel ratio feedback controls are performed by using the $NO_x$ reducing oxygen sensor to precisely and stably control the air-fuel ratio to the true theoretical air-fuel ratio richer than the pretended theoretical air-fuel ratio controlled by the conventional oxygen sensor, whereby the $NO_x$ conversion efficiency of the ternary catalyst for purging the exhaust gas, is improved to reduce $NO_x$, and therefore omission of EGR becomes possible because of reduction of $NO_x$.

In these controls, we examined the relation of the basic air-fuel ratio obtained from the fuel injection quantity computed without correction by the air-fuel ratio feedback correction coefficient to the concentrations of $NO_x$, CO and HC, and the following results were obtained (see FIG. 11).

(1) When the basic air-fuel ratio which is initially set is rich, the effect of reducing $NO_x$ by the control using the oxygen sensor having the $NO_x$-reducing catalyst layer is not attained and the levels of CO and HC are not changed but kept high.

(2) When the basic air-fuel ratio is rich, the $NO_x$-reducing effect is high, and the levels of CO and HC are not changed but kept low.

(3) When the basic air-fuel ratio is appropriate, the $NO_x$-reducing effect is moderate and also the levels of CO and HC are moderate.

Accordingly, it is at least necessary that the basic air-fuel ratio should not be rich.

Of course, no problem arises during the feedback control of the air-fuel ratio in the stationary state, but even during the feedback control of the air-fuel ratio, at the transient driving where the follow-up delay of the feedback control is caused or at the stoppage of the feedback control of the air-fuel ratio, the dependency on the basic air-fuel ratio increases and a problem arises.

The present invention is to solve this problem, and it is an object of the present invention to provide a system in which the above-mentioned oxygen sensor comprising an $NO_x$-reducing catalyst layer is combined with an apparatus for learning and controlling the basic air-fuel ratio, and the feedback control of the air-fuel ratio is performed by the oxygen sensor while the basic air-fuel ratio is learned and controlled to an appropriate or lean level, whereby the efficiency of the purging the exhaust gas by a ternary catalyst can be highly improved without any influence by the deviation of the basic air-fuel ratio owing to unevenness of parts and the like.

For attaining the above-mentioned object, a first aspect of the present invention provides an air-fuel ratio control apparatus of an internal combustion engine, which comprises, as shown in FIG. 1, the following means (A) through (I) (first invention):

(A) an engine driving state-detecting means for detecting the driving state of the engine, including at least a parameter participating in the quantity of air sucked in the engine, (B) an oxygen sensor disposed in the exhaust system of the engine to detect the air-fuel ratio of an air-fuel mixture sucked in the engine through the oxygen concentration in the exhaust gas, said oxygen sensor comprising a nitrogen oxide-reducing catalyst layer for promoting the reaction of reducing nitrogen oxides and emitting a lean or rich signal with the point of the theoretical air-fuel ratio corresponding to the nitrogen oxide concentration in the exhaust gas being as the boundary, (C) a basic fuel injection quantity-setting means for setting a basic fuel injection quantity based on said parameter detected by the engine driving state-detecting means, (D) a rewritable learning correction coefficient-storing means for storing a learning correction coefficient for correcting the basic fuel injection quantity according to the engine driving state, (E) a learning correction coefficient-retrieving means for retrieving a corresponding learning correction coefficient of the engine driving state according to the actual driving state of the engine from the learning correction coefficient-storing means, (F) an air-fuel ratio feedback correction coefficient-setting means for increasing or decreasing by a predetermined quantity the air-fuel ratio feedback correction coefficient for correcting the basic fuel injection quantity according to the rich or lean signal from the oxygen sensor, (G) a fuel injection quantity-computing means for computing a fuel injection quantity based on the basic fuel injection quantity set by the basic fuel injection quantity-setting means, the learning correction coefficient retrieved by the learning correction coefficient-retrieving means and the air-fuel ratio feedback correction coefficient set by the air-fuel ratio feedback correction coefficient-setting means, (H) a fuel-injecting means for injecting and supplying a fuel to the engine in an on-off manner according to a driving pulse signal corresponding to the fuel injection quantity computed by the fuel injection quantity-computing means, and (I) a learning correction coefficient-renewing means for learning the deviation of the air-fuel ratio feedback correction coefficient from the reference value according to the engine driving state and rewriting the learning correction coefficient of the learning correction coefficient-storing means so as to reduce said deviation.

A second aspect of the present invention provides an air-fuel ratio control apparatus of an internal combustion engine, which comprises the following means (J) in addition to the above-mentioned means (A) through (I):

(J) a learning correction coefficient-shifting means for correcting the learning correction coefficient so as t shift the air-fuel ratio to the lean side.

In the present invention, the basic fuel injection quantity-setting means sets the basic fuel injection quantity based on parameters participating in the quantity of air sucked in the engine, which are detected by the engine driving state-detecting means. The learning correction coefficient-retrieving means retrieves a learning correction coefficient corresponding to the actual engine driving state from the learning correction coefficient-storing means. Furthermore, the air-fuel ratio feedback correction coefficient-setting means sets the air-fuel ratio feedback correction coefficient, by decrease or increase of a predetermined quantity, according to a lean or rich signal from the oxygen sensor having an $NO_x$-reducing catalyst layer. The fuel injection quantity-computing means computes the fuel injection quantity by correcting the basic fuel injection quantity by the learning correction coefficient and also by the air-fuel ratio feedback correction coefficient. The fuel-injecting means is actuated by a driving pulse signal corresponding to the computed fuel injection quantity.

By the actions of the oxygen sensor and air-fuel ratio feedback correction coefficient-setting means, the feedback control of the air-fuel ratio is performed. Since the oxygen sensor has the $NO_x$-reducing catalyst layer, when the $NO_x$ concentration in the exhaust gas is increasing, the $NO_x$ component is reduced by the oxygen sensor so as to detect the real oxygen concentration. The output voltage of the oxygen sensor abruptly changes when the air-fuel ratio detected by the sensor at the point slightly richer than the pretended theoretical air-fuel ratio which was detected by the no $NO_x$-reducing oxygen sensor and a lean or rich signal is emitted with this point being as the boundary. Accordingly, if the feedback control of the air-fuel ratio is performed based on the detection result of this oxygen sensor, the air-fuel ratio is controlled to the true theoretical air-fuel ratio richer than the pretended theoretical ratio even when the $NO_x$ in the exhaust gas is changed in respect to various engine driving states and therefore decrease of $NO_x$ in the exhaust gas can be attained.

Separately, the learning correction coefficient-renewing means learns the deviation of the air-fuel ratio feedback correction coefficient from the reference value with respect to each area of the engine driving state and renews the data of the learning correction coefficient-storing means, corresponding to the area of the engine driving state, so as to reduce said deviation.

By this learning control, the basic air-fuel ratio is optimalized, and even at the stoppage of the air-fuel ratio feedback control or at the transient driving, the effect of reducing $NO_x$ can be attained.

If the learning correction coefficient-shifting means is used for slightly shifting the learning correction coefficient to shift the basic air-fuel ratio to the lean side as in the second aspect of the present invention, the effect of decreasing $NO_x$ is further improved and CO and HC can be controlled to lower levels.

The present invention will now be described in detail with reference to an optimum embodiment illustrated in the accompanying drawings, but the present invention is not limited by the embodiment and the present invention includes changes and modifications within the range of objects and technical scope of the present invention.

DETAILED DESCRIPTION OF THE PREFERRED EMBODIMENT

Figure 1:
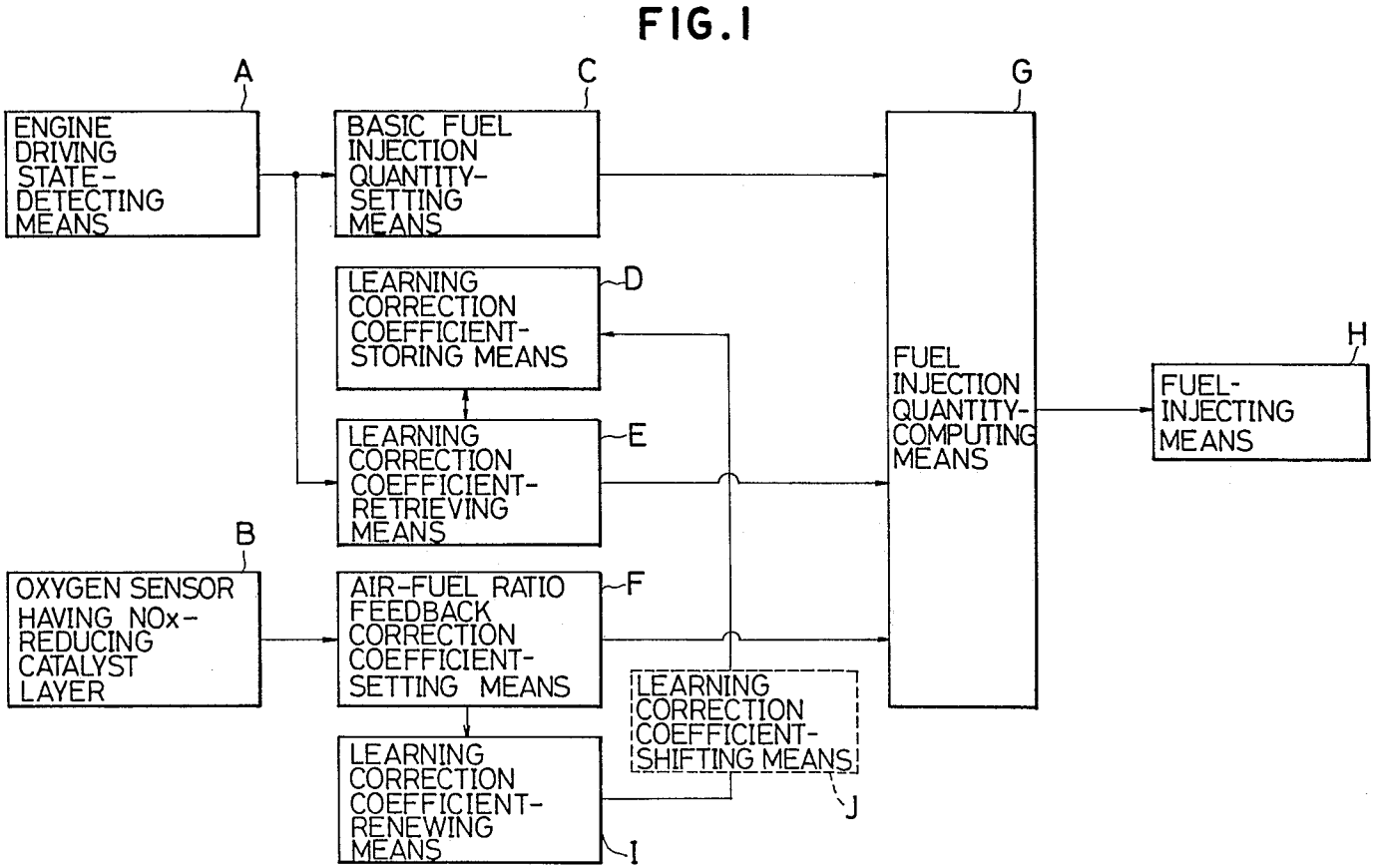
FIG. 1 is a functional block diagram illustrating the structure of the present invention.
Figure 2:
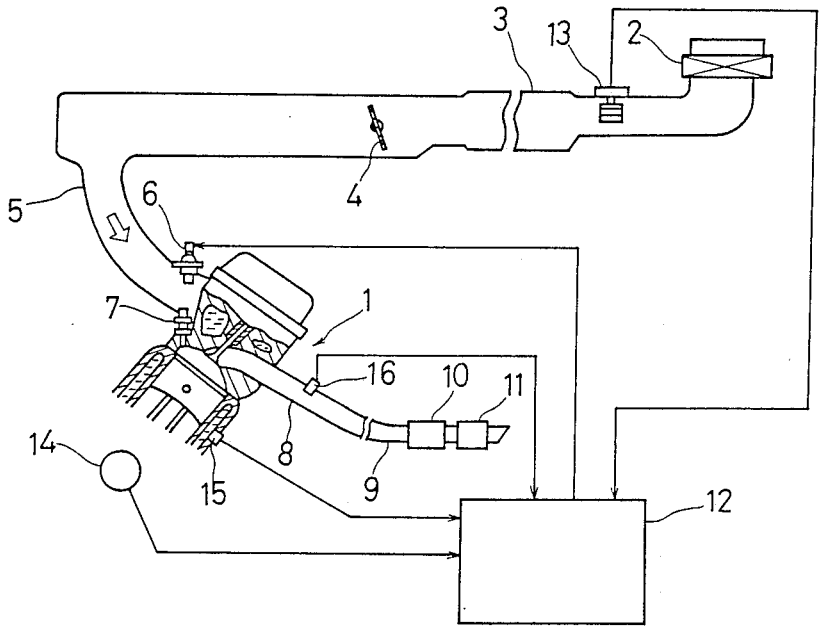
FIG. 2 is a systematic diagram illustrating one embodiment of the present invention.

Referring to FIG. 2, air is sucked in an engine 1 from an air cleaner 2 through a suction duct 3, a throttle valve 4 and a suction manifold 5. A fuel injection valve 6 as the fuel-injecting means for each cylinder is arranged in a branch portion of the suction manifold 5. The fuel injection valve 6 is an electromagnetic fuel injection valve which is opened on actuation of a solenoid and is closed on deenergization of the solenoid. Namely, the fuel injection valve 6 is opened by actuation by a driving pulse signal from a control unit 12 described hereinafter, and a fuel fed under pressure by a fuel pump not shown in the drawings is injected and supplied under a predetermined pressure adjusted by a pressure regulator. Incidentally, although the multi-point injection system is adopted in the present embodiment, there can be adopted a single-point injection system in which a single fuel injection valve commonly used for all of cylinders is arranged, for example, upstream of the throttle valve.

An ignition plug 7 is arranged in a combustion chamber of the engine 1, and an air-fuel mixture is ignited and burnt by spark ignition by the ignition plug 7.

An exhaust gas is discharged from the engine 1 through an exhaust manifold 8, an exhaust duct 9, a ternary catalyst 10 and a muffler 11. The ternary catalyst 10 is an exhaust gas-purging device for oxidizing CO and HC in the exhaust gas and reducing $NO_x$ and converting them to harmless substances. The conversion efficiency has a close relation to the air-fuel ratio of the sucked air-fuel mixture (see FIG. 10).

The control unit 12 is provided with a micro-computer comprising CPU, ROM, RAM, an A/D converter and an input-output interface. The control unit 12 receives input signals from various sensors, performs computation processings as described below and controls the operation of the fuel injection valve 6.

As one of the various sensors, a hot-wire air flow meter 13 is arranged in the suction duct 3 to put out a voltage signal corresponding to a sucked air flow quantity Q.

Furthermore, a crank angle sensor 14 is arranged to put out, for example in case of a four-cylinder engine, reference signals at every 180° of the crank angle and unit signals at every 1° or 2° of the crank angle. By measuring the frequency of the reference signals or the number of unit signals generated for a predetermined time, the revolution number N of the engine can be determined.

Moreover, a water temperature sensor 15 for detecting the cooling water temperature Tw is arranged in a water jacket of the engine 1.

In the present embodiment, these air flow meter 13 and crank angle sensor 14 constitute the engine driving state-detecting means.

An oxygen sensor 16 is arranged in an assembly portion of the exhaust manifold 8 to detect the air-fuel ratio of the sucked air-fuel mixture through the oxygen concentration in exhaust gas.

Figure 3:
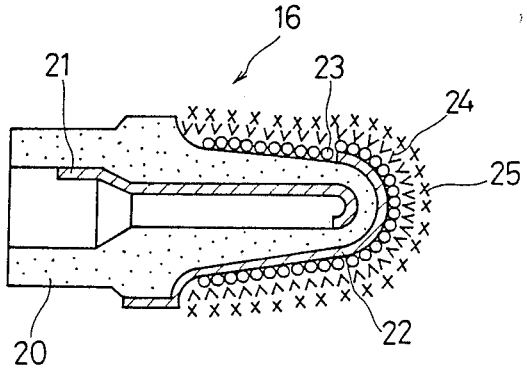
FIG. 3 is a sectional view showing the main part of the oxygen sensor.

In the present embodiment, the sensor portion of the oxygen sensor 16 has a structure shown in FIG. 3. The oxygen sensor 16 is a bottomed cylindrical tube 20 of zirconia ($ZrO_2$) having a closed end to be exposed to an exhaust gas, which is an oxygen ion conductor used as the solid electrolyte for a concentration cell, and in this oxygen sensor 16, inner and outer electrodes 21 and 22 composed of platinum are formed on the inner and outer surface of the tube 20 and a platinum catalyst layer 23 is formed on the outer surface of vacuum deposition of platinum acting as an oxidizing catalyst. A rhodium catalyst layer 24 comprising rhodium (Rh) acting as an $NO_x$-reducing catalyst, which is supported on titanium oxide ($TiO_2$) or lanthanum oxide ($La_2O_3$), is formed on the outside of the platinum catalyst layer 23. Incidentally, ruthenium (Ru) can also be used as the $NO_x$-reducing catalyst. Furthermore, a protecting layer 25 for protecting the platinum catalyst layer 23 and the rhodium catalyst layer 24 is formed on the outside of the catalyst layer 24 by melt-spraying of a metal oxide such as magnesium spinel.

Accordingly, when $NO_x$ contained in the exhaust gas reaches the rhodium catalyst layer 24, the rhodium catalyst layer 24 promotes the following reactions between $NO_x$ and the unburnt components CO and HC contained in the exhaust gas:

$$NO_x + CO \rightarrow N_2 + CO_2$$

$$NO_x + HC \rightarrow N_2 + H_2O + CO_2$$

As the result, the amounts of the unburnt components CO and HC, to be reacted with $O_2$ arriving at the platinum catalyst player 23 located on the inner side of the rhodium catalyst layer 24, are reduced by the reactions in the rhodium catalyst layer 24, and therefore, the $O_2$ concentration is proportionally increased.

Figure 4:
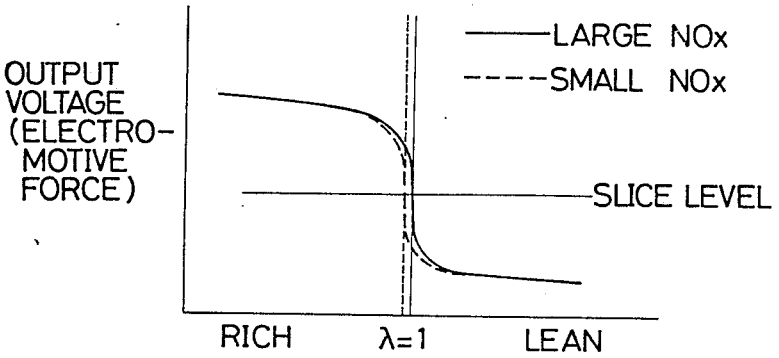
FIG. 4 is a diagram illustrating the output voltage characteristic of the oxygen sensor.

Accordingly, the difference of the $O_2$ concentration between the inner side and outer side of the zirconia tube 20, that is, the difference between the $O_2$ concentration on the inner side, i.e., the outer air side, and the $O_2$ concentration on the outer side, i.e., on the exhaust gas side, decreases, and as shown in FIG. 4, the electromotive force generated between the electrodes 21 and 22 is reduced below the slice level at the theoretical air-fuel ratio ($\lambda=1$). The theoretical air-fuel ratio is the true one richer than the pretended theoretical air-fuel ratio detected by the conventional oxygen sensor not having the $NO_x$ reducing catalyst and when the $NO_x$ concentration in the exhaust gas is changed to a higher or lower level, the theoretical air-fuel ratio detected is not deviated from the stable value of the theoretical air-fuel ratio. In this connection, in the conventional oxygen sensor which do not have the $NO_x$ reducing activity, the detected theoretical air-fuel ratio was not kept at the stable value.

Figure 5:
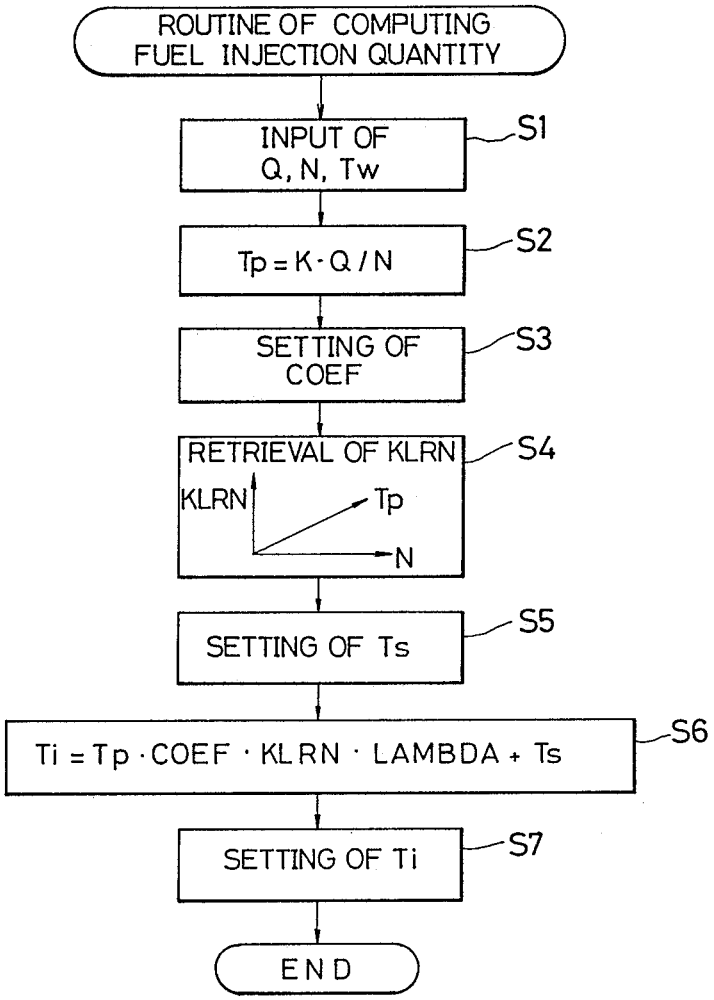
FIGS. 5 through 7 are flow charts showing the contents of the computing processings.
Figure 6:
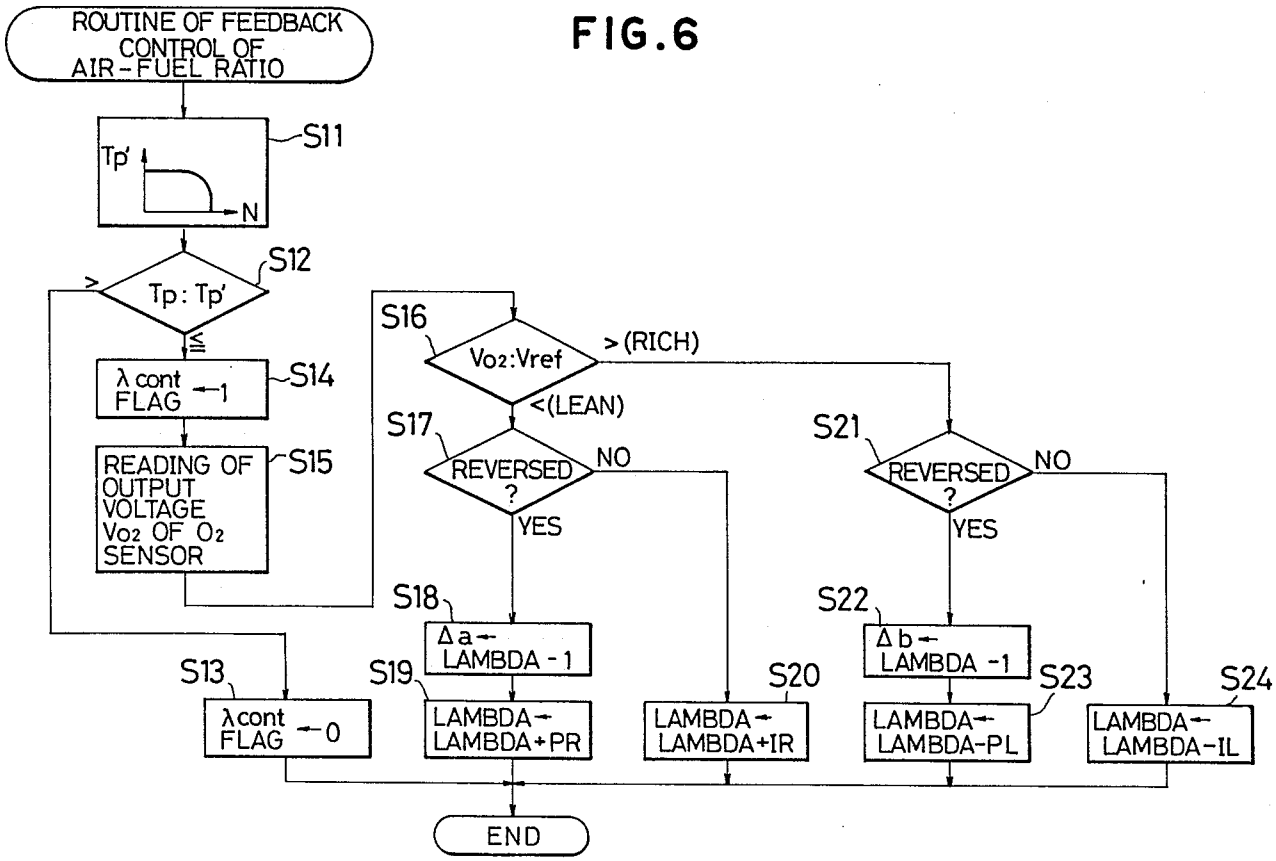
Figure 7:
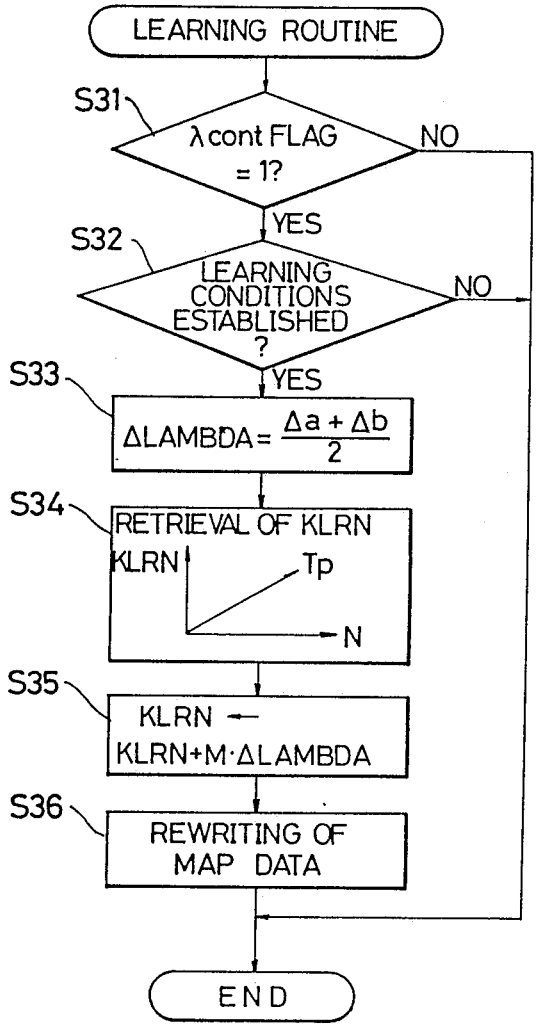

In the present embodiment, CPU of the micro-computer unit 12 performs computing processings according to programs (fuel injection quantity-computing routine, air-fuel ratio feedback control routine and learning routine) on ROM, shown as flow charts in FIGS. 5 through 7, and controls the injection of the fuel.

Incidentally, the functions of the basic fuel injection quantity-setting means, learning correction coefficient-retrieving means, air-fuel ratio feedback correction coefficient-setting means, fuel injection quantity-computing means and learning correction coefficient-renewing means are exerted according to the above-mentioned programs. RAM is used as the learning correction coefficient-storing means, and the stored content is maintained by a back-up power source even after an engine key is turned off.

The computing processing of the micro-computer in the control unit 12 will now be described with reference to the flow charts of FIGS. 5 through 7.

FIG. 5 shows the fuel injection quantity-computing routine is conducted at every predetermined time interval.

At step 1 (shown as "Sl" in the drawings; the same will apply hereinafter), the sucked air flow quantity Q detected based on the signal from the air flow meter 13, the engine revolution number N detected based on the signal from the crank angle sensor 14 and the water temperature Tw detected based on the signal from the water temperature sensor 15 are put in.

At step 2, the basic fuel injection quantity $Tp=K.Q/N$ (K is a constant) corresponding to the quantity of air sucked per unit revolution is calculated from the sucked air quantity Q and the engine revolution number N. The portion of this step 2 corresponds to the basic fuel injection quantity-setting means.

At step 3, the correction coefficient $COEF=1+KTw+KMr+\ldots$ including various correction coefficients such as the water temperature correction coefficient KTw corresponding to the water temperature Tw and the mixing ratio correction coefficient KMr corresponding to the engine revolution number N and basic fuel injection quantity Tp is set.

At step 4, by referring to a map on RAM as the learning correction coefficient-storing means for storing the learning correction coefficient KLRN corresponding to the engine revolution number N and the basic fuel injection quantity Tp indicating the engine driving state, KLRN corresponding to actual N and Tp is retrieved and read. The portion of this step 4 corresponds to the learning correction coefficient-retrieving means. Incidentally, in the map of the learning correction coefficient KLRN, the engine revolution number N and basic fuel injection quantity Tp are plotted on the abscissa and ordinate, respectively, and areas of the engine driving state are defined by lattices of about 8 x about 8 and the learning correction coefficient KLRN is stored for each area. At the point when learning is not initiated, the initial value of 1 is stored in all the areas.

At step 5, a voltage correction quantity Ts is set based on the battery voltage. This is to correct the change of the injection flow rate of the fuel injection valve 6, which is caused by the fluctuation of the battery voltage.

Then, at step 6, the fuel injection quantity Ti is calculated according to the formula of $Ti=Tp.COEF.KLRN.LAMBDA+Ts$. The portion of this step 6 corresponds to the fuel injection quantity-computing means.

Incidentally, LAMBDA is the air-fuel ratio feedback correction coefficient, which is set according to the air-fuel ratio feedback control routine shown in FIG. 6. The reference value of LAMBDA is 1.

The so-calculated fuel injection quantity Ti is set at an output register at step 7, and at a predetermined fuel injection timing synchronous with the revolution of the engine (for example, at each revolution), a driving pulse signal having a pulse width of most newly set Ti is put out to the fuel injection valve 6 to effect injection of the fuel.

FIG. 6 shows the air-fuel ratio feedback control routine, which is conducted synchronously with the revolution or at a predetermined number of revolutions to set the air-fuel ratio feedback correction coefficient LAMBDA. Accordingly, this routine corresponds to the air-fuel ratio feedback correction coefficient-setting means.

At step 11, a comparative value Tp' for the basic fuel injection quantity is retrieved from the engine revolution number N, and at step 12, the actual basic fuel injection quantity Tp is compared with the comparative value Tp'.

In case of $Tp>Tp'$, the routine goes into step 13 to set $\lambda$ control flag at O and this routine ends. Accordingly, the air-fuel ratio feedback correction coefficient LAMBDA is clamped to the preceding value (or reference value of 1) to stop the feedback control of the air-fuel ratio. Namely, in the high-load region, the feedback control of the air-fuel ratio is stopped and a rich output air-fuel ratio is obtained by the mixing ratio correction coefficient KMr, whereby elevation of the exhaust gas temperature is controlled and seizure of the engine 1 or burning of the ternary catalyst 10 is prevented.

In case of $Tp\leqq Tp'$, the routine goes into step 14 to set $\lambda$ control flag at 1, and the routine goes into step 15. This is to perform the feedback control of the air-fuel ratio in the low or medium revolution region or the low or medium load region.

At step 15, the output voltage Vo2 of the oxygen sensor 16 is read, and at step 16, this voltage Vo2 is compared with the slice level voltage Vref to judge whether the air-fuel ratio is lean or rich with reference to the theoretical air-fuel ratio. In view of the characteristics of the oxygen sensor 16 having the $NO_x$-reducing catalyst layer, the judgement is not made based on the pretended theoretical air-fuel ratio to be detected by using the conventional oxygen sensor without the $NO_x$ reducing function but based on the real theoretical air-fuel ratio determined according to the $NO_x$ concentration (see FIG. 4).

ficient LAMBDA is increased at a certain gradient. Incidentally, the relation of PR>>IR is established.

When the air-fuel ratio is rich (Vo2 >Vref), the routine goes into step 21 from step 16, and it is judged whether or not the air-fuel ratio has been reversed to the rich side from the lean side (just after the reversion). When the reversion is judged, the routine goes into step 12, and for the learning routine of FIG. 7 described hereinafter, the deviation Δb=LAMBDA−1 from the reference value of the preceding air-fuel ratio feedback correction coefficient LAMBDA, that is, 1, is stored. Then, the routine goes into step 23, and the air-fuel ratio feedback correction coefficient LAMBDA is decreased by a predetermined proportion constant PL from the preceding value. When the reversion is not judged, the routine goes into step 24 and the air-fuel ratio feedback correction coefficient LAMBDA is decreased by a predetermined integration constant IL from the preceding value. Thus, the air-fuel ratio feedback correction coefficient LAMBDA is decreased at a certain gradient. Incidentally, the relation of PL>IL is established.

FIG. 7 shows the learning routine, which is conducted as the background job to set and renew the learning correction coefficient KLRN. Accordingly, this routine corresponds to the learning correction coefficient-renewing means.

At step 31, it is judged whether or not λ control flag is 1. If λ control flag is 1, the routine ends. The reason is that learning cannot be performed when the feedback control of the air-fuel ratio is stopped.

At step 32, it is judged whether or not predetermined learning conditions are established. When the water temperature Tw is higher than the predetermined value, the area of the engine driving state is set by the engine revolution number N and basic fuel injection quantity Tp, the frequency of the reversion of lean and rich signals is larger than a predetermined value (for example, 3) and the engine is in the stationary state, it is judged that the learning conditions are established. If these conditions are not satisfied, this routine ends.

Figure 8:
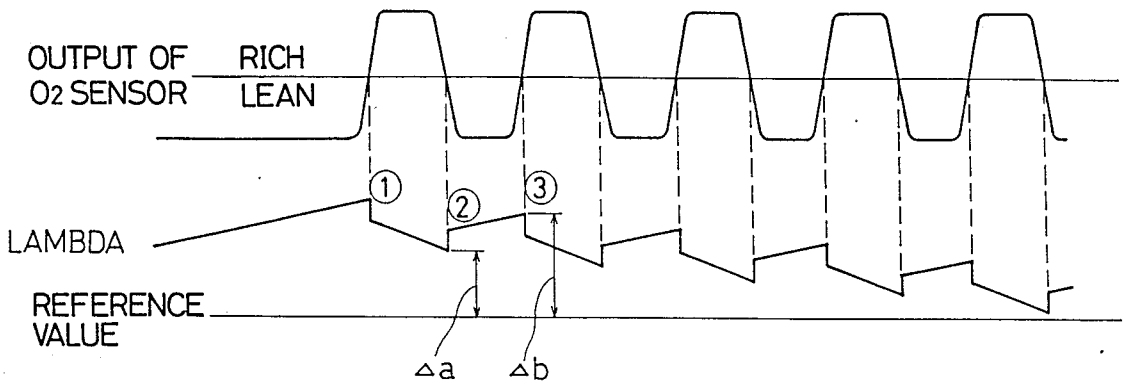
FIG. 8 is a diagram showing the change of the air-fuel ratio feedback correction coefficient.

In the case where the predetermined learning conditions are established while the feedback control of the air-fuel ratio is conducted and the area of the engine driving state to be learned is set, the routine goes into step 33 and the mean value of Δa and Δb is determined. Stored Δa and Δb are upper and lower peak values of the deviation from the reference value of the air-fuel ratio feedback correction coefficient LAMBDA, that is, 1, between the reversions of the air-fuel ratio feedback correction coefficient LAMBDA in the increasing and decreasing directions, as shown in FIG. 8. By deterwherein M is an addition ratio constant which is in the range of $1 \geqq M > 0$.

Then, the routine goes into step 36, and the data of the learning correction coefficient KLRN in the same area of the map on RAM is rewritten.

In this feedback control of the air-fuel ratio, the air-fuel ratio periodically changes with the change of the air-fuel ratio feedback correction coefficient LAMBDA, and the central control value is the value obtained when the output voltage of the oxygen sensor 16 is reversed.

As pointed out hereinbefore, as the $NO_x$ concentration in the exhaust gas is high, the output voltage of the oxygen sensor 16 is reversed at a point of the real the theoretical air-fuel ratio which is kept at a predetermined constant value, which is richer than the pretended theoretical air-fuel ratio detected by the oxygen sensor without the $NO_x$ reduction activity, even though the $NO_x$ concentration changes.

Figure 9:
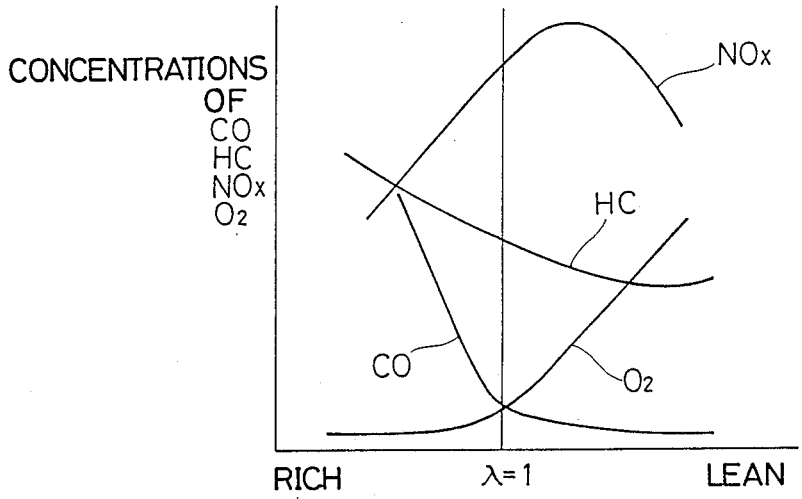
FIG. 9 is a graph illustrating the relation between the air-fuel ratio and the concentrations of the exhaust gas components.
Figure 10:
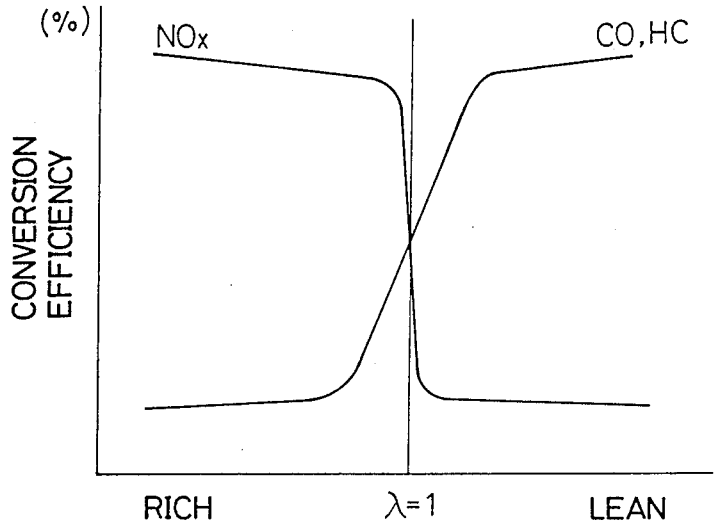
FIG. 10 is a graph illustrating the efficiency of the conversion by the ternary catalyst.
Figure 11:
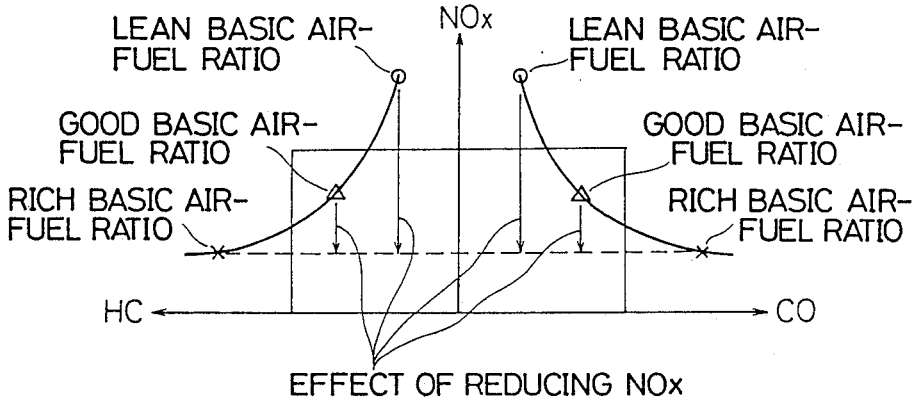
FIG. 11 is a graph illustrating the relation between the basic air-fuel ratio and the concentrations of the exhaust gas components.

As the air-fuel ratio becomes richer than the pretended theoretical air-fuel ratio, the $NO_x$ concentration in the exhaust gas tends to decrease, as shown in FIG. 9, and if the air-fuel ratio becomes the true theoretical air-fuel ratio slightly richer than the pretended theoretical air-fuel ratio, the $NO_2$ conversion efficiency of the ternary catalyst 10 drastically increases without the significant change of the concentration of $NO_x$, CO and HC and the conversion efficiency in the catalyst as shown in FIG. 10.

Accordingly, as the amount generated of $NO_x$ is going to increase, the amount discharged of $NO_x$ can be efficiently reduced by enriching the air-fuel ratio.

If this control system is adopted, an EGR apparatus customarily used as means for reducing $NO_x$ becomes unnecessary, and the cost can be drastically reduced. Furthermore, since reduction of the combustion efficiency by EGR can be avoided, the output performance can be improved and the amounts discharged of CO and HC can be reduced.

Furthermore, if learning control is adopted in combination with the above-mentioned control system, since the basic air-fuel ratio is optimalized, the effect of reducing $NO_x$ can be obtained even at the stoppage of the feedback control of the air-fuel ratio or at the transient driving, and CO and HC can also be reduced.

Figure 12:
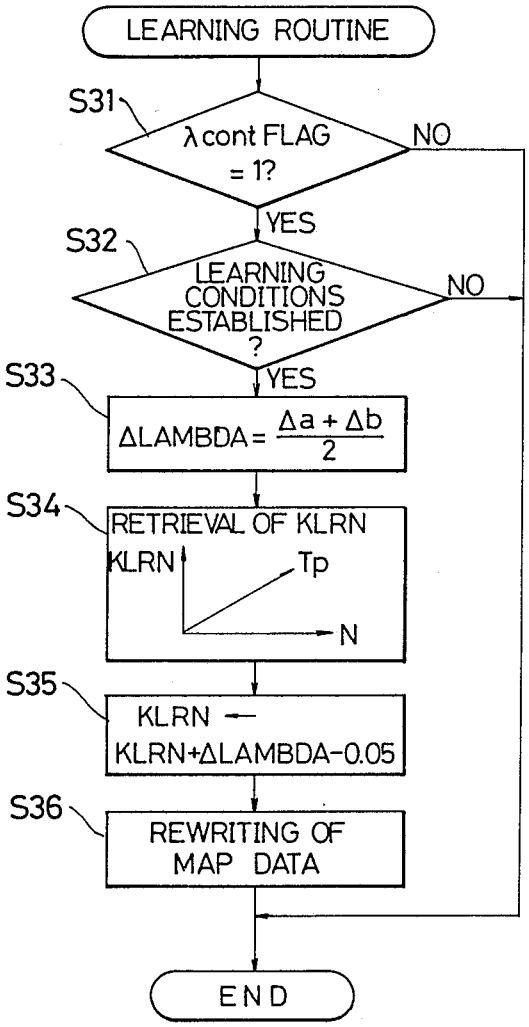
FIG. 12 is a flow chart showing the learning routine according to another embodiment.

FIG. 12 is a flow chart of the learning routine according to the second invention, which is different from the above-mentioned routine only in the portion of step 35.

More specifically, at step 35 of FIG. 12, according to the formula given below, the deviation ΔLAMBDA of the air-fuel ratio feedback correction coefficient from the reference value is added to the present learning correction coefficient KLRN and a new learning correction coefficient KLRN is computed by subtracting a predetermined value (for example, 0.05) from the obtained sum:

$$KLRN \leftarrow KLRN + \Delta LAMBDA - 0.05$$

Thus, the basic air-fuel ratio can be shifted to the lean side, and the effect of reducing $NO_x$ can be further improved.

In this case, the portion of subtraction of the predetermined value (0.05) corresponds to the learning correction coefficient-shifting means. Furthermore, there may be adopted a modification in which the predetermined value (0.05) is subtracted from the learning correction coefficient KLRN retrieved at step 4 shown in FIG. 5 and the obtained value is used for computing the fuel injection quantity Ti.

As is apparent from the foregoing description, according to the present invention, even if there is a deviation of the basic air-fuel ratio because of unevenness of parts or the like, the basic air-fuel ratio can be optimalized or controlled to the lean side by the learning control, and the effect of reducing $NO_x$ by the feedback control of the air-fuel ratio by using the oxygen sensor having the $NO_x$-reducing catalyst layer can be exerted even at the stoppage of the feedback control of the air-fuel ratio or the transient driving. Moreover, CO and HC can be effectively reduced.

I claim:

1. An electronic air-fuel control apparatus in an internal combustion engine, which comprises:

an engine driving state-detecting means for detecting the driving state of the engine, including at least a parameter participating in the quantity of air sucked in the engine;

an oxygen sensor disposed in the exhaust system of the engine to detect the air-fuel ratio of an air-fuel mixture sucked in the engine through the oxygen concentration in the exhaust gas, said oxygen sensor comprising a nitrogen oxide-reducing catalyst layer for promoting the reaction of reducing nitrogen oxides and emitting a lean or rich signal with the point of the theoretical air-fuel ratio corresponding to the oxygen concentration including the oxygen in the nitrogen oxide concentration in the exhaust gas being as the boundary;

a basic fuel injection quantity-setting means for setting a basic fuel injection quantity based on said parameter detected by the engine driving state-detecting means;

a rewritable learning correction coefficient-storing means for storing a learning correction coefficient for correcting the basic fuel injection quantity according to the engine driving state;

a learning correction coefficient-retrieving means for retrieving a corresponding learning correction coefficient of the engine driving state according to the actual driving state of the engine from the learning correction coefficient-storing means;

an air-fuel ratio feedback correction coefficient-setting means for increasing or decreasing by a predetermined quantity the air-fuel ratio feedback correction coefficient for correcting the basic fuel injection quantity according to the rich or lean signal from the oxygen sensor;

a fuel injection quantity-computing means for computing a fuel injection quantity based on the basic fuel injection quantity set by the basic fuel injection quantity-setting means, the learning correction coefficient retrieved by the learning correction coefficient-retrieving means and the air-fuel ratio feedback correction coefficient set by the air-fuel ratio feedback correction coefficient-setting means;

a fuel-injecting means for injecting and supplying a fuel to the engine in an on-off manner according to a driving pulse signal corresponding to the fuel injection quantity computed by the fuel injection quantity-computing means; and a learning correction coefficient-renewing means for learning the deviation of the air-fuel ratio feedback correction coefficient from the reference value according to the engine driving state and rewriting the learning correction coefficient of the learning correction coefficient-storing means so as to reduce said deviation.

2. An electronic air-fuel ratio control apparatus in an internal combustion engine according to claim 1, wherein the oxygen sensor comprises an oxygen ion electroconductor used as a solid electrolyte for a concentration cell, inner and outer electrodes formed on the inner and outer surface of said oxygen ion electroconductor an oxidation catalyst layer formed on the exhaust side of the oxygen ion electroconductor and a nitrogen oxide-reducing catalyst layer arranged on the outside of said oxidation catalyst layer.

3. An electronic air-fuel ratio control apparatus in an internal combustion engine according to claim 2, wherein said oxygen ion electroconductor is made of zirconia exposed to the exhaust gas, said oxidation catalyst layer is made of platinum and said nitrogen oxide-reducing catalyst layer comprises rhodium and/or ruthenium carried on lutenium oxide and/or lanthanium oxide.

4. An electronic air-fuel ratio control apparatus in an internal combustion engine according to claim 2, wherein said oxygen sensor further comprises a protecting layer for protecting said nitrogen oxide-reducing catalyst layer and being formed on the outside of said nitrogen oxide-reducing catalyst layer.

5. An electronic air-fuel ratio control apparatus in an internal combustion engine according to claim 2, wherein said oxygen ion electroconductor is formed in a tube type with a closed end exposed to the exhaust gas.

6. An electronic air-fuel ratio control apparatus in an internal combustion engine according to claim 1, wherein said fuel injection quantity-computing means computes a fuel injection quantity Ti based on a following formula, $$Tp = K.Q/N$$

$$Ti = Tp.COEF.KLRN.LAMBDA + Ts$$

where K stands for a constant, Q stands for a quantity of air sucked into the engine, Tp stands for a basic fuel injection quantity, COEF stands for correction coefficients set by a corresponding various kinds of engine driving states, KLRN stands for a learning correction coefficient, LAMBDA stands for an air-fuel ratio feedback correction coefficient and Ts stands for a correction quantity pertaining to a fluction of a battery voltage for the engine.

7. An electronic air-fuel ratio control apparatus in an internal combustion engine according to claim 6, wherein said learning correction coefficient-renewing means renews a present learning correction coefficient $KLRN_{PRESENT}$ to a new learning correction coefficient $KLRN_{NEW}$ in the following formula, $$KLRN_{NEW} \leftarrow KLRN_{PRESENT} + M.\Delta LAMBDA$$

where M stands for an addition ratio constant which is in a range of $1 \geqq M > 0$, ΔLAMBDA stands for an average deviation from a reference value of the air-fuel ratio feedback correction coefficient LAMBDA.

8. An electronic air-fuel ratio control apparatus in an internal combustion engine according to claim 7, wherein said learning correction coefficient-renewing means effectively renews the learning correction coefficient only when a predetermined learning condition is established.

9. An electronic air-fuel control apparatus in an internal combustion engine, which comprises:

an engine driving state-detecting means for detecting the driving state of the engine, including at least a parameter participating in the quantity of air sucked in the engine;

an oxygen sensor disposed in the exhaust system of the engine to detect the air-fuel ratio of an air-fuel mixture sucked in the engine through the oxygen concentration in the exhaust gas, said oxygen sensor comprising a nitrogen oxide-reducing catalyst layer for promoting the reaction of reducing nitrogen oxides and emitting a lean or rich signal with the point of the theoretical air-fuel ratio corresponding to the oxygen concentration including the oxygen in the nitrogen oxide concentration in the exhaust gas being as the boundary;

a basic fuel injection quantity-setting means for setting a basic fuel injection quantity based on said parameter detected by the engine driving state-detecting means;

a rewritable learning correction coefficient-storing means for storing a learning correction coefficient for correcting the basic fuel injection quantity according to the engine driving state;

a learning correction coefficient-retrieving means for retrieving a corresponding learning correction coefficient of the engine driving state according to the actual driving state of the engine from the learning correction coefficient-storing means;

an air-fuel ratio feedback correction coefficient-setting means for increasing or decreasing by a predetermined quantity the air-fuel ratio feedback correction coefficient for correcting the basic fuel injection quantity according to the rich or lean signal from the oxygen sensor;

a fuel injection quantity-computing means for computing a fuel injection quantity based on the basic fuel injection quantity set by the basic fuel injection quantity-setting means, the learning correction coefficient retrieved by the learning correction coefficient-retrieving means and the air-fuel ratio feedback correction coefficient set by the air-fuel ratio feedback correction coefficient-setting means;

a fuel-injecting means for injecting and supplying a fuel to the engine in an on-off manner according to a driving pulse signal corresponding to the fuel injection quantity computed by the fuel injection quantity-computing means;

a learning correction coefficient-renewing means for learning the deviation of the air-fuel ratio feedback correction coefficient from the reference value according to the engine driving state and rewriting the learning correction coefficient of the learning correction coefficient-storing means so as to reduce said deviation; and a learning correction coefficient-shifting means for correcting the learning correction coefficient so as to shift the air-fuel ratio to the lean side.

* * * * *